US008896489B2

(12) United States Patent
Larsen et al.

(10) Patent No.: US 8,896,489 B2
(45) Date of Patent: Nov. 25, 2014

(54) ANTENNA

(75) Inventors: Niels B. Larsen, Escondido, CA (US); Ping Hui, San Diego, CA (US); Yonghua Wei, San Diego, CA (US); Francis McGaffigan, Escondido, CA (US); Nan Xu, San Diego, CA (US); Kiril Stoynov, San Diego, CA (US)

(73) Assignee: Nokia Corporation, Espoo (FI)

( * ) Notice: Subject to any disclaimer, the term of this patent is extended or adjusted under 35 U.S.C. 154(b) by 153 days.

(21) Appl. No.: 13/475,345

(22) Filed: May 18, 2012

(65) Prior Publication Data

US 2013/0307736 A1 Nov. 21, 2013

(51) Int. Cl.
*H01Q 1/24* (2006.01)
*H01Q 1/38* (2006.01)

(52) U.S. Cl.
USPC ..... 343/702; 343/700 MS

(58) Field of Classification Search
USPC ..... 343/700 MS, 702
See application file for complete search history.

(56) References Cited

U.S. PATENT DOCUMENTS

| | | | | |
|---|---|---|---|---|
| 7,126,539 | B2 * | 10/2006 | Li et al. | 343/700 MS |
| 2003/0112200 | A1 | 6/2003 | Marino | 343/824 |
| 2006/0055615 | A1 | 3/2006 | Zhou | 343/790 |
| 2009/0135082 | A1 | 5/2009 | Hou | 343/878 |
| 2010/0253579 | A1 * | 10/2010 | Ryou et al. | 343/700 MS |

FOREIGN PATENT DOCUMENTS

| | | | |
|---|---|---|---|
| EP | 1298760 | A1 | 4/2003 |

* cited by examiner

*Primary Examiner* — Hoang V Nguyen
(74) *Attorney, Agent, or Firm* — Harrington & Smith

(57) ABSTRACT

An apparatus including an antenna; a first antenna carrier forming a first support substrate for a first portion of the antenna; and a different second antenna carrier forming a second support substrate for a second portion of the antenna. The first and second antenna carriers are coupled to each other. The antenna extends across a joint between the first and second antenna carriers.

25 Claims, 10 Drawing Sheets

ANTENNA

BACKGROUND

1. Technical Field

The exemplary and non-limiting embodiments relate generally to an antenna and, more particularly, to an antenna on different antenna carriers.

2. Brief Description of Prior Developments

There are more and more antennas being integrated into devices, such as mobile phones for example, owing to a growing number of bands and protocols used for wireless communications. Mobile terminal antennas are usually placed on a single plastic or ceramic carrier, support or frame.

SUMMARY

The following summary is merely intended to be exemplary. The summary is not intended to limit the scope of the claims.

In accordance with one aspect, an apparatus is provided including an antenna; a first antenna carrier forming a first support substrate for a first portion of the antenna; and a different second antenna carrier forming a second support substrate for a second portion of the antenna. The first and second antenna carriers are fixedly connected to each other. The antenna extends across a joint between the first and second antenna carriers.

In accordance with another aspect, a method comprises forming a first antenna carrier comprising a first manufacturing method; providing a first antenna element of an antenna on the first antenna carrier, where the first antenna carrier forms a first substrate for the first antenna element; forming a second antenna carrier comprising a second different manufacturing method; providing a second antenna element of the antenna on the second antenna carrier, where the second antenna carrier forms a second different substrate for the second antenna element; and coupling the first and second antenna elements to each other.

In accordance with another aspect, an apparatus comprising an antenna comprising an active element and a parasitic element; and an antenna support having the antenna thereon, where the antenna support comprises a first antenna carrier fixedly coupled to a second different antenna carrier. The active element is on the first antenna carrier. The first antenna carrier is formed with a first manufacturing process with a first material. The parasitic element is on the second antenna carrier. The second portion is formed with a second different manufacturing process with a second different material. It should be noted that aspects and principles relating to manufacturing are not limited to using different manufacturing technologies. The principles can be applied even with use of a same manufacturing technology or similar manufacturing technologies.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
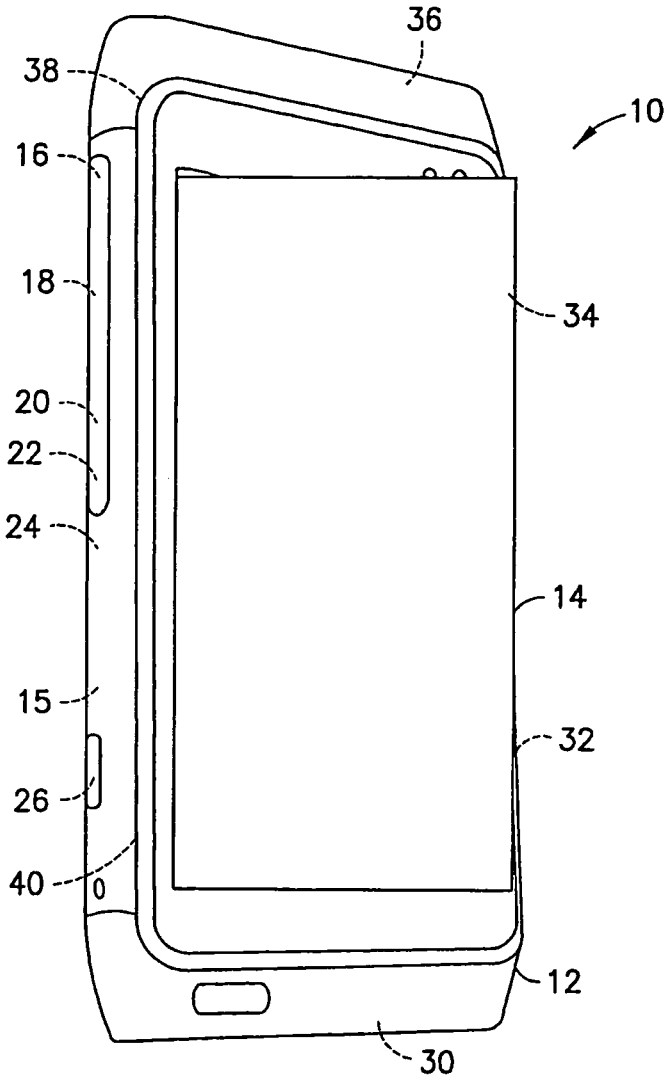
FIG. 1 is a perspective view of an apparatus comprising features as described herein.

Referring to FIG. 1, there is shown a perspective view of an apparatus 10 according to an example embodiment. In this example the apparatus 10 is a hand-held portable apparatus comprising various features including a telephone application, Internet browser application, camera application, video recorder application, music player and recorder application, email application, navigation application, gaming application, and/or any other suitable electronic device application. The apparatus may be any suitable electronic device which has an antenna, such as a mobile phone, computer, laptop, PDA, etc., for example The apparatus 10, in this example embodiment, comprises a housing 12, a touch screen 14 which functions as both a display and a user input, and electronic circuitry including a printed wiring board (PWB) 15 having at least some of the electronic circuitry thereon. The electronic circuitry can include, for example, a receiver 16, a transmitter 18, and a controller 20. The controller 20 may include at least one processor 22, at least one memory 24, and software. A rechargeable battery 26 is also provided.

The apparatus 10 includes multiple antennas. In this example the antennas include a main antenna 30, a MIMO (multiple-input and multiple-output) antenna 32, a WLAN (wireless local area network) antenna 34, a Diversity RX antenna 36, a GPS/GLASS (Global Positioning System/Global Navigation Satellite System) antenna 38 and an LTE (Long Term Evolution) antenna 40. In alternate examples more or less antennas could be provided, and the antennas may be for any suitable purpose other than those noted above and/or any radio frequency communication protocol or frequency band.

Features as described herein may be used for antennas for a mobile terminal. However, it should be noted that the apparatus may be used in any suitable portable electronic device, such as a mobile phone, computer, laptop, tablet, PDA, etc., for example. There are more antennas being integrated into mobile terminals owing to a growing number of bands and protocols. Mobile terminal antennas are usually placed on a single plastic or ceramic carrier. The antenna carrier is needed for some types of antenna constructions because of the structure and method of manufacture. For example, flex forming an antenna requires a substrate for the metal conductor. Otherwise the metal conductor would easily break. The antenna radiator or radiating element (metal part) would not be able to exist very long without a carrier. Likewise, a LDS manufacturing method of forming an antenna needs a substrate (the antenna carrier) for the antenna to be formed on. The antenna radiator (metal part) would not be able to be formed without a carrier. Thus, certain antennas need both an antenna carrier and a radiator on that carrier to form the antenna. In the past, a single antenna placed across two or more different material carriers using the same or different manufacturing processes has not been provided. With features as described herein, multiband antennas may be provided on more than a single carrier. An antenna can be integrated with speakers and other electrical and/or mechanical components.

Figure 2:
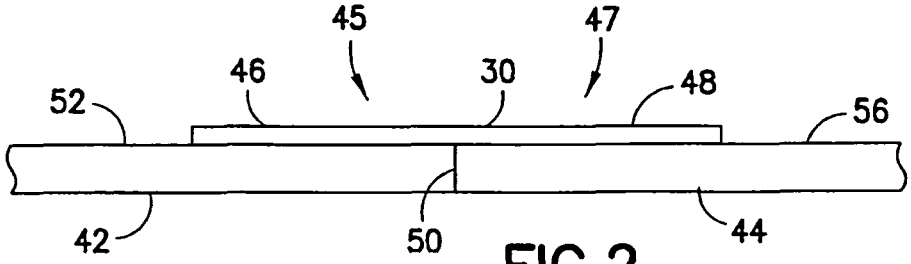
FIG. 2 is a diagram illustrating features of an antenna of the apparatus shown in FIG. 1.

Referring also to FIG. 2, the main antenna 30 is formed on both a first antenna carrier 42 and a second different antenna carrier 44. In this example, the first antenna carrier 42 is a substantially rigid plastic or polymer member forming part of the housing 12 of the apparatus 10. The antenna 30 has a first portion 45 on the first antenna carrier 42 and a second portion 47 on the second antenna carrier 44. The first portion 45 could include, for example, a first antenna element 46 formed on the first antenna carrier 42 by Laser Direct Structuring (LDS).

LDS is the most widely used method to produce a cell phone handset antenna. It is now being used to integrate Wi-Fi, Bluetooth, GPS and cellular antenna into housings and enclosures. A laser light activates a special additive into the plastic (an organic metal complex) so that it will accept electroplated copper and also roughens the plastic surface to help the plating adhere.

The second different antenna carrier 44 in this example is a flexible substrate with a second antenna element 48 of the antenna 30 formed thereon. The second portion 47 includes the second antenna element 48. In this example the second carrier 44 and second antenna element 48 are a flex circuit or printed flexible circuit 56. The method of manufacturing a flex circuit is a different method of manufacture than a method using LDS to form an antenna element on a plastic substantially rigid housing member. For a flex circuit (or flexible printed circuit (FPC)) the metal electrical conductor is formed over the flexible substrate. A flexible flat cable (FFC) could also be provided, such as laminating very thin copper strips in between two layers of Polyethylene Terephthalate (PET). For LDS, the electrical conductor is formed on the plastic.

In the example shown, the second antenna carrier 44 is fixedly connected to the first antenna carrier 42, and the first and second antenna elements 46, 48 are coupled to each other to form the single antenna 30. A joint 50 exists between the two carriers 42, 44. In FIG. 2 the joint 50 is shown as a straight vertical joint between the two carriers 42, 44. However, in an alternate embodiment the joint 50 may not be straight. The joint 50 could also be horizontal. For example, the joint could be provided where the substrate 44 of the flex circuit is bonded to the inside surface 52 of the first carrier 42. In other example embodiments, the joint 50 may provide a surface area larger than that provided by a straight or horizontal joint. For example, the joint may be zig-zag or meander shaped. This can advantageously provide a more robust mechanical joint, for example, if the two different carriers 42, 44, are to be adhered together at the joint 50.

In other example embodiments, the joint 50 may also have interlocking surfaces such that the first carrier 42 has a surface shaped such that it mechanically interlocks with a surface of the second carrier 44. In this example, the interlocking shaped surfaces of the two carriers 42, 44, advantageously provide a more stable mechanical joint 50. This may, for example, improve the tolerance build-up in the case where two different materials are used for the two different carriers 42, 44. One material may have a different tolerance compared to the other material for example.

Figure 3:
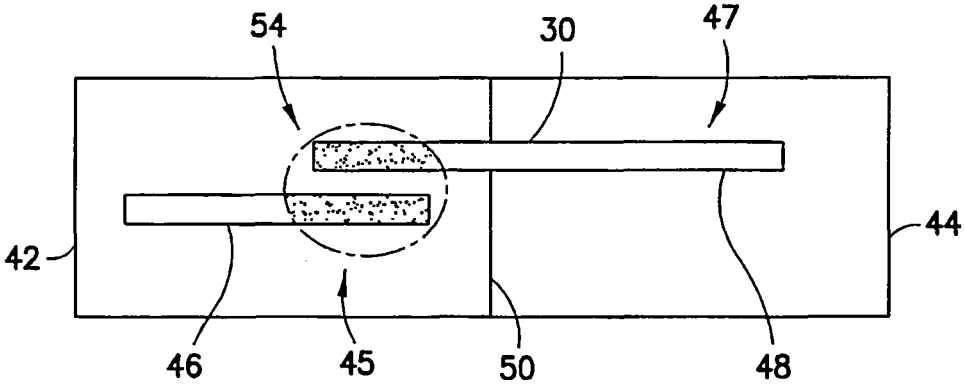
FIG. 3 is a diagram illustrating features of an example of the antenna shown in FIG. 2.

An example of an embodiment corresponding to FIG. 2 is shown in FIG. 3. In this example the second carrier 44 stops at the joint 50. However, the second antenna element 48 of the antenna 30 extends past the edge of the second carrier 44 onto the first carrier 42. In other words, the second antenna element 48 of the antenna 30 extends over the joint 50 (bridges over the joint 50) between the two carriers 42, 44. An electrical coupling or connection 54 is provided between the two antenna elements 46, 48. In this example embodiment the first portion 45 includes the first antenna element 46 and part of the second antenna element 48, and the second portion 47 only includes a part of the second antenna element 48. In this example, the first antenna element 46 is an active antenna element of the main antenna 30, and the second antenna element 48 is a parasitic antenna element of the main antenna 30. In other words, the first antenna element 46 is a fed antenna element, or an active or driven element with respect to the other directly grounded element (parasitic) 48. This example illustrates that the coupling area 54 may be moved away from the joint 50. The two mechanical parts (the carriers 42, 44) can also be on different levels. In other words, the first antenna element 46 may lie in a different plane to that of the second antenna element 48. For example, when components are in a stacked relationship. The antenna 30 is fed by radio circuitry. In other words, the antenna has at least one feed coupled to radio circuitry. There may be one, or perhaps more than one, individual connection(s)/coupling(s) to the radio circuitry.

The flex 56 can go from one height to another height. One antenna element may be located underneath the other antenna element so long as they are coupled to form the single antenna. By moving the critical coupling between the two antenna elements 46, 48 away from joint to only one of the carriers, the tolerance of the coupling can be better controlled. The transition from carrier to carrier can then be handled by designing a strong mechanical connection. For example, if a coupling required is 1 pF (picofarad), and this value is critical, then this should be placed on one carrier (which can therefore provide a tight tolerance) away from the mechanical joint between the carriers. The mechanical joint between carriers (which would have a relatively loose tolerance) could then be handled by increasing trace size significantly to increase the spanning of the joint by the selected antenna element. The difference between 99 pF and 200 pF (due to carrier tolerance) is less critical, and can be considered similar to a through or open circuit at higher operating frequency (even though capacitive reactance has a non-linear response versus frequency). In other words, a portion of the antenna (not the capacitively coupled area), which is more insensitive to mechanical tolerance changes than other portions of the antenna, may be purposefully placed over the joint. Even though the mechanical tolerances provide a capacitance change of 99-200 pF for example, this has little RF effect on the antenna resonant frequency.

It could also be that a single antenna radiator, i.e. there is no parasitic element, and that this single radiator has along its length different magnitudes of current distribution. It is known in the art that the current distribution changes along the length of an antenna radiator from feed to open end. So if the current distribution is at its maximum near the feed point of the antenna [E-field=Max], then the open end will be a zero current location [E-field=Minimum]. Hence, placing the open end of the antenna radiator near the mechanical joint where dimensional stability or tolerance is a potential problem, will reduce the effect of the mechanical tolerance on the control of RF parameters of the antenna radiator. In other antenna types, the feed point may be minimum E-field at the feed and so the reverse situation could be arranged.

Due to factors such as mechanical tolerance control for example, one antenna system implemented on different carriers using different manufacturing technologies has not been provided in the past. With features described herein, an antenna may be provided on different carriers; using two different carriers to form a single antenna. For example, an active antenna element 46 may be on a LDS carrier 42, and a parasitic element 48 may be on a flex plastic carrier 44. As another example, an active antenna element may be provided on a flex plastic carrier and a parasitic element may be provided on a LDS carrier. The parasitic element may be connected to the ground directly, or via a circuit network for example.

Mechanical tolerance control may be addressed in various different ways. There are always mechanical gaps or displacement when two mechanical parts are joined together. Mechanical tolerance of the joined parts affects couplings of electromagnetic fields between the active and parasitic antenna elements, yielding frequency shift of final antenna resonant frequency. This may be the practical limitation why others have not provided an antenna on two or more different carriers using different manufacturing technologies in the past.

There are at least two ways to reduce effects of mechanical tolerance of a joint on antenna resonance frequency: a Radio Frequency (RF) way and/or a mechanical way. For an RF way, the critical coupling area can be moved away from the mechanical joint, or change the coupling mechanism, such as using magnetic (H) coupling, instead of electrical (E) coupling across the mechanical joint for example. For a mechanical way, one may glue two mechanical parts together, and/or interlocking two mechanical parts together using dovetail latches, and/or adding alignment features (alignment posts for example) such as on a LDS carrier for flex assembly to mitigate Flexible Printed Circuit (FPC) assembly variability.

Figure 4:
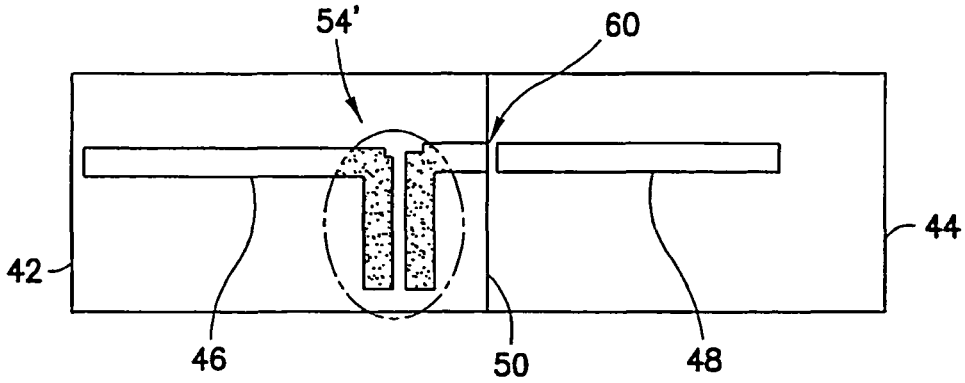
FIG. 4 is a diagram illustrating features of an example of the antenna shown in FIG. 2.

For a magnetic coupling, this may also be provided spaced from the joint 50. Referring also to FIG. 4, an example embodiment is shown where a direct electrical coupling 54' is provided between the first and second antenna elements 46, 48 on the first carrier 42. The second antenna element 48 spans the joint 50 between the two carriers 42, 44 at 60.

Figure 5:
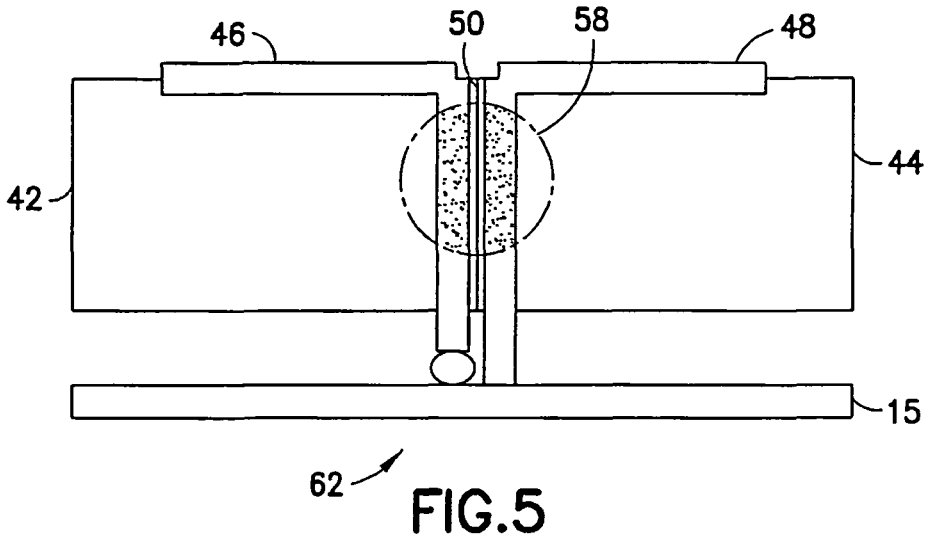
FIG. 5 is a diagram illustrating features of an example of the antenna shown in FIG. 2.

Referring also to FIG. 5, an example embodiment is shown where a magnetic coupling 58 near the joint 50 may be provided. Magnetic coupling may be less sensitive to surrounding dielectric materials, such as when the dielectric material of carriers has a same permeability for example. Placing the antenna element, feed or ground connection 62 close to each other on the PWB 15 may be provided. This has the advantage that the feed or ground connection position can be important for this coupling, and can be controlled by using a third part, such as the PWB 15 for example (not just the two carriers 42, 44).

Figure 6:
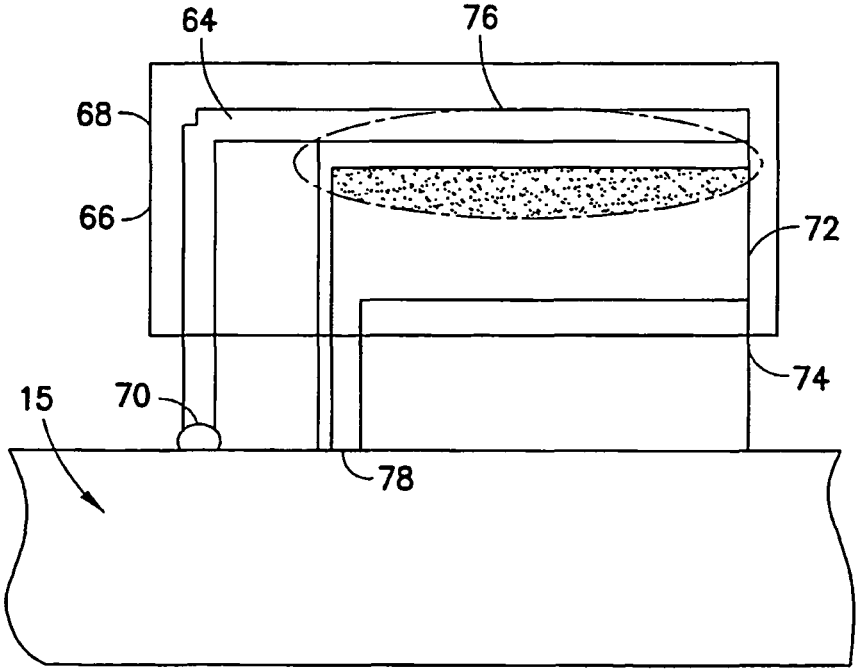
FIG. 6 is a diagram illustrating features of an example of the antenna shown in FIG. 2.
Figure 7:
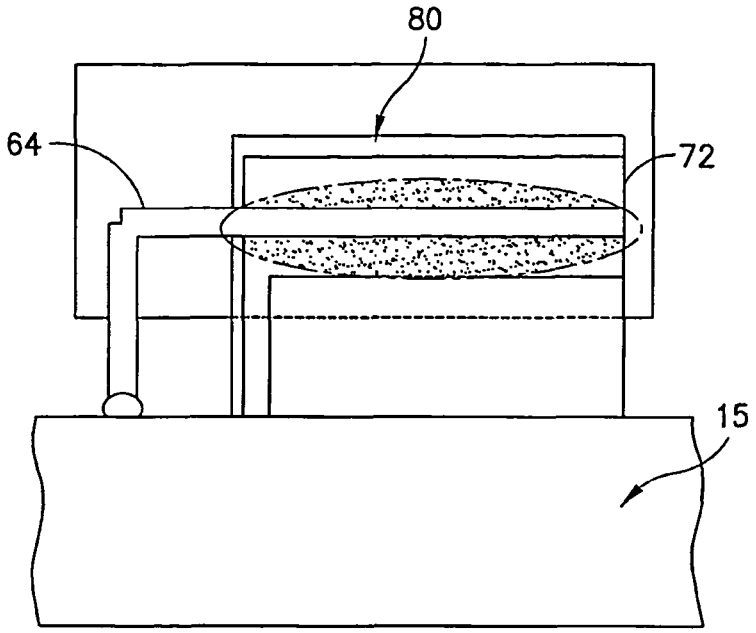
FIG. 7 is a diagram illustrating features of an example of the antenna shown in FIG. 2.

Referring also to FIG. 6, an example embodiment is shown where the coupling mechanism may be altered to compensate for mechanical variation, such as changing from the side coupling shown in FIG. 6 to a vertical stacking coupling as shown in FIG. 7. For the embodiment shown in FIG. 6, the active antenna element 64 is provided on a flexible printed circuit substrate or carrier 66 as a flexible printed circuit (FPC) 68. An end 70 of the active antenna element 64 is mounted to the printed wiring board (PWB) 15 and further coupled to radio frequency circuitry (not illustrated), for example, at least one of a receiver, transmitter, transceiver and associated radio frequency circuitry. The parasitic antenna element 72 is provided on a substantially rigid frame member 74 formed by LDS for example. The two elements 64, 72 are coupled by a side-by-side arrangement at 76. The parasitic element 72 can be connected via a ground connection at 78 to the PWB 15, where the PWB comprises at least one conductive layer which is configured to provide a ground plane for the antenna.

It will be understood by persons skilled in the art that a feed connection and a ground connection may provide either a galvanically coupled or an electromagnetically (capacitive or inductive) coupled connection between the antenna and the radio frequency circuitry and/or the ground plane for example.

Vertical stacking coupling can provide better control of height than horizontal displacement in terms of mechanical dimensions and their relative tolerances. Referring also to FIG. 7, a further stacked example embodiment is shown. In this example there is a vertical stack-up arrangement 80 of the two elements 64, 72.

Figure 8:
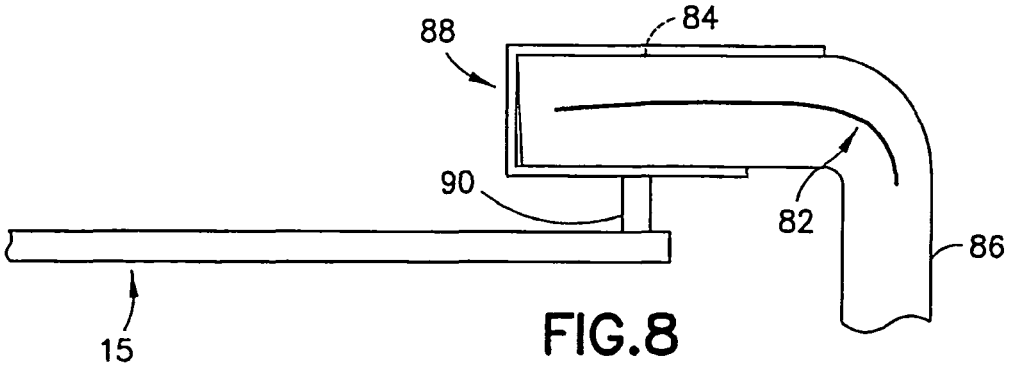
FIG. 8 is a diagram illustrating features of an example of the antenna shown in FIG. 2.

Referring also to FIG. 8, an example embodiment is shown with an in-mold LDS application. In this example the apparatus comprises two antenna elements 82, formed by a member 86 having an in-mold LDS antenna radiator and an electrical conductor of a flex circuit 88. A metal contact 90 connects the second element 84 to the PWB 15. The two elements 82, 84 may be electro-magnetically coupled for example. The flex 88 (with radiator 84) wraps around the in-mold LDS carrier 86 to form proper coupling of the elements 82, 84.

Figure 9:
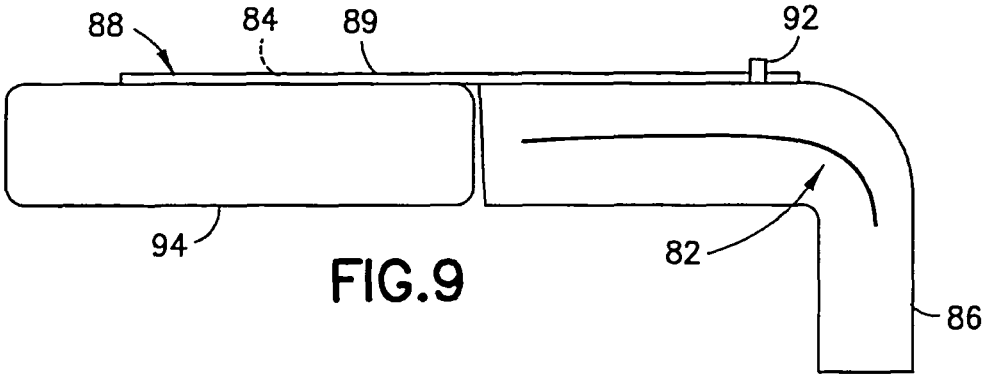
FIG. 9 is a diagram illustrating features of an example of the antenna shown in FIG. 2.

Referring also to FIG. 9, another example embodiment is shown. In this example, the antenna comprises the first carrier 86 and first antenna element 82, and the flex circuit 88 having the second carrier 89 and second antenna element 84. The first carrier 86 has an alignment pole 92. The flex circuit 88 has a hole which allows the flex 88 to mount on the alignment pole 92. The flex 88 can be further supported, at least in part, on a third member 94 in addition to the first carrier 86. The two elements 82, 84 may be electro-magnetically coupled for example. This example illustrates that the flex 88 (with radiator 84) may be provided on top of the in-mold LDS carrier to form a proper coupling between the two antenna elements 82, 84.

Figure 10:
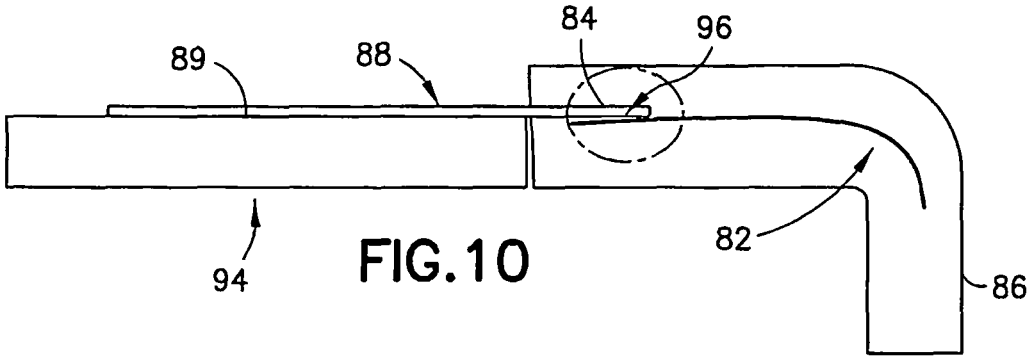
FIG. 10 is a diagram illustrating features of an example of the antenna shown in FIG. 2.

Referring also to FIG. 10, another example embodiment is shown. In this example, the antenna comprises the first carrier 86 and first antenna element 82, and the flex circuit 88 having the second carrier 89 and second antenna element 84. In this example the first carrier 86 has been overmolded on the flex 88 with the two antenna elements 82, 84 in direct metal-to-metal contact at 96 inside the in-mold LDS carrier 86.

It should be noted that the above examples should not be considered as limiting. Features as described herein may be used in any suitable types of configurations. Advantages of features described herein include:

More flexibility to implement antennas.

More available space and area to implement antennas.

A single antenna radiator can be spread across more than one carrier by minimizing the detrimental effect on RF performance by mechanical tolerances.

Active and parasitic antenna elements can be on surfaces of different carriers.

Most RF sensitive parts of the antenna elements can be located away from the junction between the at least two support parts, so that any mechanical tolerance stack issues are avoided.

Features can be provided with a single antenna placed across two or more different material carriers which are manufactured using different manufacturing processes. More specifically, at least one antenna element or radiator can be configured to be disposed across a junction between a first support part and a second support part, wherein the first and second support parts comprise different materials having different dielectric constants.

A fed antenna element can be placed on a first support part and a parasitic element can be placed on a second support part. The junction between the two different support parts can become a "coupling zone" between the fed antenna element and parasitic elements such as shown in FIG. 5 for example. The junction can also be used as a coupling gap between a first portion of an antenna element and a second portion of the antenna element such as shown in FIG. 4 for example. The junction may be a vertical face of two different support parts or a horizontal face such as shown in FIG. 7 for example. Novel features include having an antenna radiator disposed across two different support parts, and positioning the portions of the antenna radiator, which are in terms of the magnitude of the current distribution or E and H fields least sensitive, across the junction(s) between the different support parts.

Features as described herein include a mechanical solution to the problem of having high antenna numbers in a small product volume. Put another way, products are not getting any bigger and more antenna radiators are needed to fit into this same or less volume space. So, to be able to place, for example, a low band fed radiator (not including parasitic element) across at least two different dielectric bodies is an advantage. For example, one might be the frame 12 of the product in PC/ABS, and the other might be a polycarbonate dielectric body; each body having different dielectric constants and loss tangent or tan delta). The problem faced when doing this is that the antenna might suffer resonant frequency shifting due to tolerance stack issues of the mechanical dimensions in the mechanical integration of these different bodies. A proposed solution is to place the most sensitive portions of the radiator on one of the bodies, and the less sensitive portions across the gap between the bodies and/or on the second body.

In one example embodiment an apparatus is provided comprising an antenna 30; a first antenna carrier 42 forming a first support substrate for a first portion 45 of the antenna; and a different second antenna carrier 44 forming a second support substrate for a second portion 47 of the antenna, where the first and second antenna carriers 42, 44 are fixedly connected to each other, and where the antenna 30 extends across a joint 50 between the first and second antenna carriers 42, 44.

The antenna 30 may comprise a parasitic element and a non-parasitic element (an active element which is fed or coupled to radio frequency circuitry), where the second portion of the antenna comprises the parasitic element 48, and where the first portion of the antenna comprises the active element 46. The antenna may comprise a radiating element, where the radiating element comprises a first portion having a first E-field magnitude and a second portion having a second E-field magnitude, where the second E-field magnitude is lower than the first E-field magnitude and the second portion is configured to extend across the joint. For example, the lower magnitude of the second E-field could be a minimum, and the first E-field magnitude could be a maximum. The first portion of the antenna may comprise a part of the parasitic element 48. The first antenna carrier 42 may be formed by a first manufacturing process with a first material, and the second antenna carrier 44 may be formed with a second different manufacturing process with a second different material. The first antenna carrier may be a flex plastic carrier, and the second antenna carrier may be a Laser Direct Structuring (LDS) carrier. The first antenna carrier may be a Laser Direct Structuring (LDS) carrier, and the second antenna carrier may be a flex plastic carrier. The first antenna element of the antenna may be coupled to the second antenna element of the antenna on the first antenna carrier at a location spaced from the joint. The first antenna element of the antenna may be coupled to the second antenna element of the antenna by a magnetic coupling. The first antenna element of the antenna may be coupled to the second antenna element of the antenna by an electrical coupling. The antenna may comprise a first antenna element and a second element, where the second antenna element forms the second portion and part of the first portion, the second antenna element extends across the joint, and where the first antenna element does not extend across the joint. The first portion of the antenna may be coupled to the second portion of the antenna on the first antenna carrier at the joint. The first portion of the antenna may be coupled to the second portion of the antenna by a magnetic coupling. The first portion of the antenna may be coupled to the second portion of the antenna by an electrical coupling. The first and second antenna carriers may be in a partially stacked configuration, and the joint may be at a plane in the stacked configuration, such as perhaps at least partially in a plane different from a plane containing the first and second antenna elements.

Figure 11:
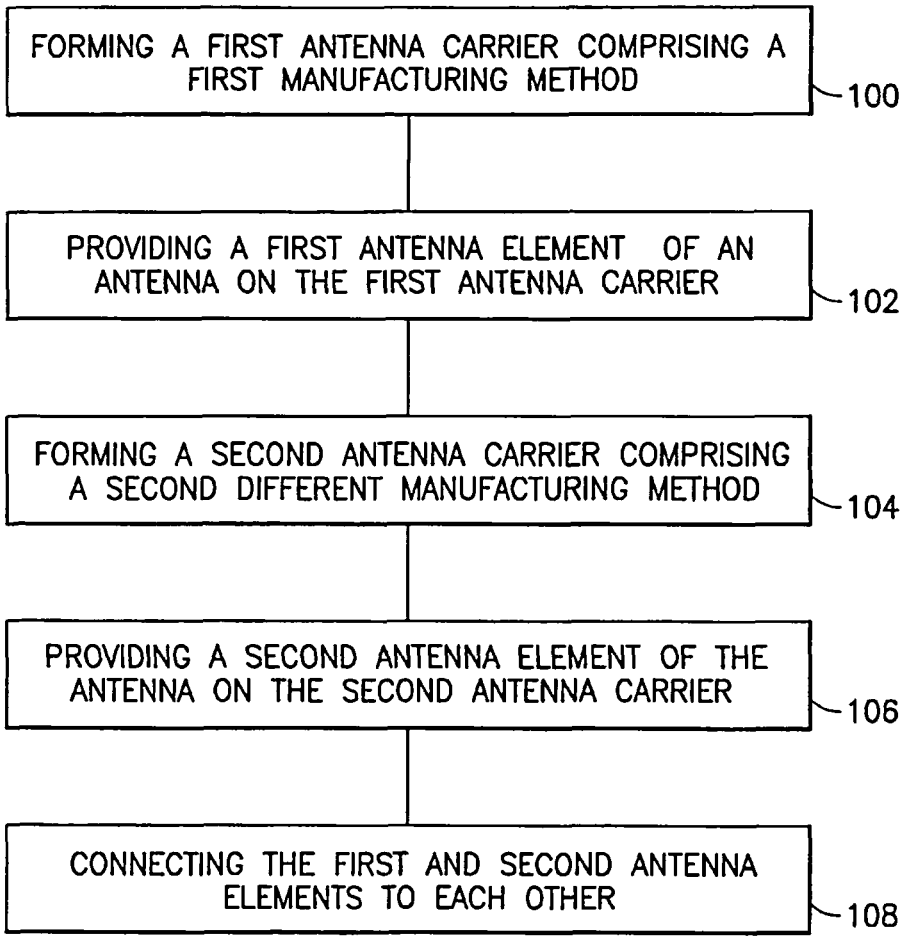
FIG. 11 is a diagram illustrating an example method.

Referring also to FIG. 11, an example method may comprise forming a first antenna carrier comprising a first manufacturing method as indicated by block 100; providing a first antenna element of an antenna on the first antenna carrier as indicated by block 102, where the first antenna carrier forms a first substrate for the first antenna element; forming a second antenna carrier comprising a second different manufacturing method as indicated by block 104; providing a second antenna element of the antenna on the second antenna carrier as indicated by block 106, where the second antenna carrier forms a second different substrate for the second antenna element; and coupling the first and second antenna elements to each other as indicated by block 108.

The first and second methods may each comprise a different one of the following: forming a flex carrier, forming a Laser Direct Structuring (LDS) carrier, forming an overmolded member on the first antenna element or second antenna element, forming a molded carrier, for example in ABS/PC, or forming an overmolded member on the first antenna element and the first antenna carrier or forming an overmolded member on the second antenna element and the second antenna carrier. In one of the simplest methods, one might just use a piece of molded plastic as a carrier, where no overmolding is done. The antenna maybe provided by a flex circuit which is adhered to the top surface of the molded carrier or heat-staked to it. The antenna may also be provided by a piece of sheet metal, stamped out and folded in a two-dimensional or three-dimensional shape, and then attached to the molded carrier. Coupling the first and second antenna elements may comprise the first antenna element being coupled to the second antenna element on the first antenna carrier at a location spaced from a joint between the first and second antenna carriers. The first antenna element may be coupled to the second antenna element by a magnetic coupling. The first antenna element may be coupled to the second antenna element by an electrical connection. The method may comprise the second antenna element extending across a joint between the first and second antenna carriers, where the second antenna element is provided on the first antenna carrier, and where the first antenna element does not extend across the joint. The method may comprise coupling the first antenna element to the second antenna element at the joint between the first and second antenna carriers. The method may comprise coupling the first antenna element to the second antenna element by a magnetic coupling. The method may comprise coupling the first antenna element to the second antenna element by a direct electrical connection with each other. The method may comprise stacking the first antenna carrier with the second antenna carrier in a partially stacked configuration, and where a joint between the first and second antenna carriers is at a plane in the stacked configuration.

In one example embodiment the apparatus may comprise an antenna 30 comprising an active element 46 and a parasitic element 48; and an antenna support having the antenna thereon, where the antenna support comprises a first antenna carrier 42 fixedly connected to a second different antenna carrier 44, where the active element is on the first antenna carrier, where the first antenna carrier is formed with a first manufacturing process with a first material, and where the parasitic element is on the second antenna carrier, where the second portion is formed with a second different manufacturing process with a second different material.

Figure 12:
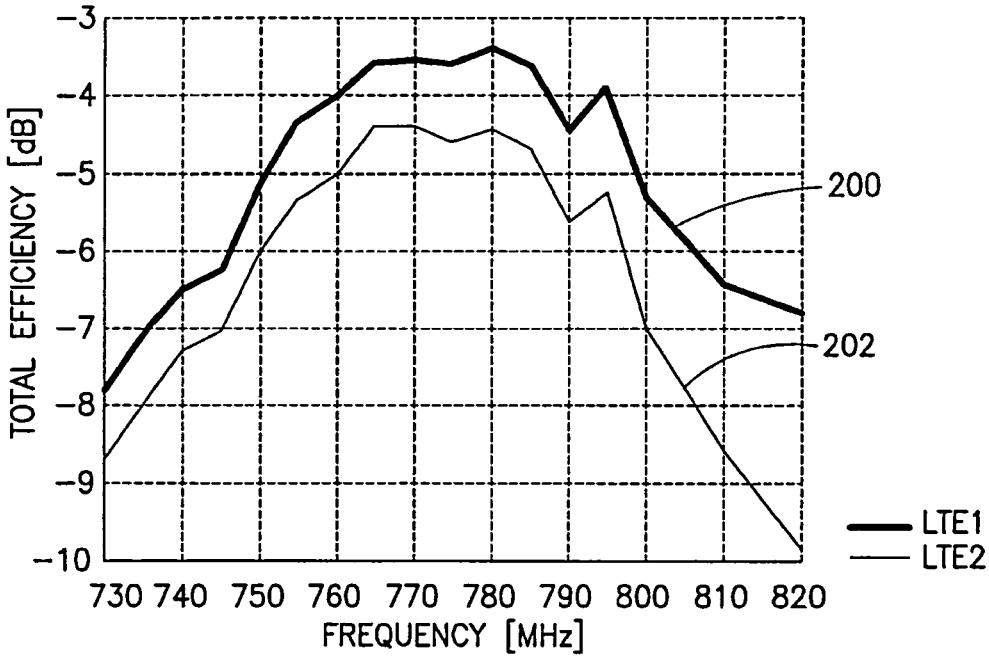
FIG. 12 is a chart illustrating total efficiency relative to frequency for a LTE antenna having a monopole element and a parasitic element (LTE1) and a LTE antenna having a monopole element and no parasitic element (LTE2)
Figure 13:
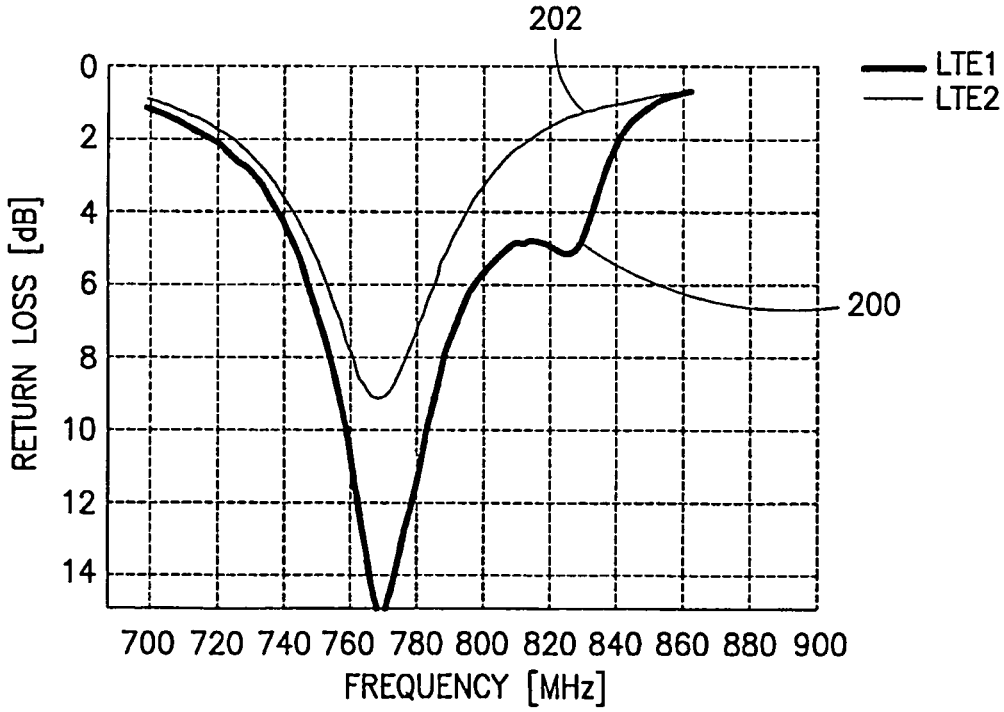
FIG. 13 is a chart illustrating return loss for the antennas corresponding to FIG. 12.
Figure 14:
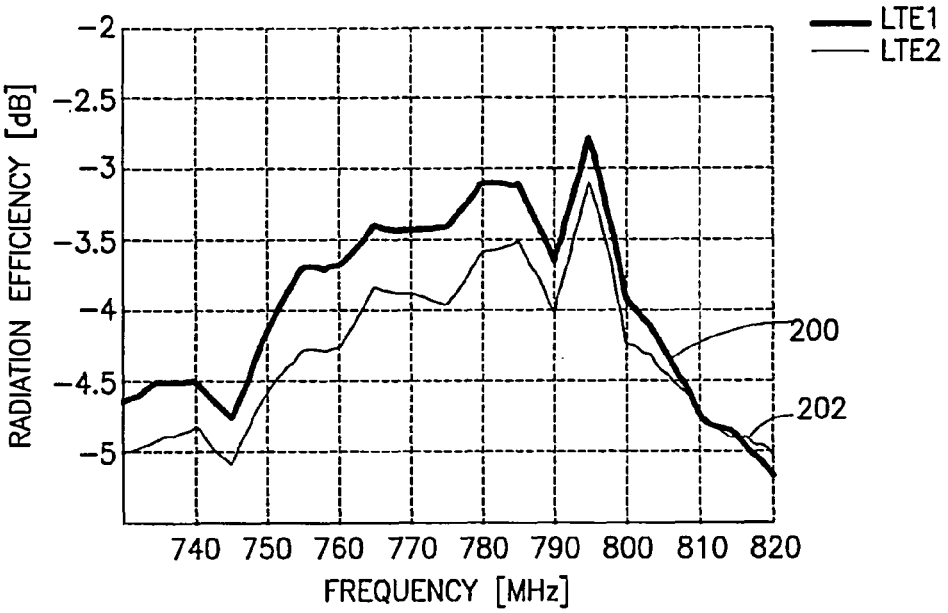
FIG. 14 is a chart illustrating radiation efficiency for the antennas corresponding to FIG. 12.

Referring also to FIG. 12, a chart is shown illustrating total efficiency to frequency for two antennas. The first line 200 is in regard to a LTE (Long Term Evolution) antenna having a monopole antenna element and a parasitic antenna element (LTE1). The measurements for line 200 were taken from an antenna having the two antenna elements on different carriers. The second line 202 is in regard to a LTE (Long Term Evolution) antenna having a monopole antenna element and no parasitic antenna element (LTE2). Thus, this diagram is shown to discuss a LTE antenna on a single carrier (LTE 2) and a LTE antenna on one carrier and its parasitic element on another carrier (LTE1). As can be seen in comparing 200 versus 202, the total efficiency for the LTE (Long Term Evolution) antenna having a monopole antenna element and a parasitic antenna element (LTE1) is better than total efficiency for the LTE (Long Term Evolution) antenna having a monopole antenna element and no parasitic antenna element (LTE2). FIG. 12 shows that total antenna efficiency has been improved with a parasitic element on another carrier (LTE1) over the LTE antenna on the single carrier (LTE2). FIGS. 13 and 14 show similar better results for return loss and radiation efficiency of the LTE1 versus the LTE2. Thus, it is clearly better to have an LTE antenna with both a monopole antenna element and a parasitic antenna element provided on different carriers than merely a monopole antenna. FIG. 13 shows the improvement of bandwidth as well as matching due to the parasitic element on the other carrier.

Better matching leads to improvement of total efficiency. With a parasitic element, matching is improved (as shown in FIG. 13). Thus, total efficiency as shown in FIG. 12 is improved. The parasitic element improves radiation efficiency, as shown in FIG. 14. In other words, there are two aspects for the improvement of total efficiency: from better matching as well as from improved radiation efficiency.

Figure 15:
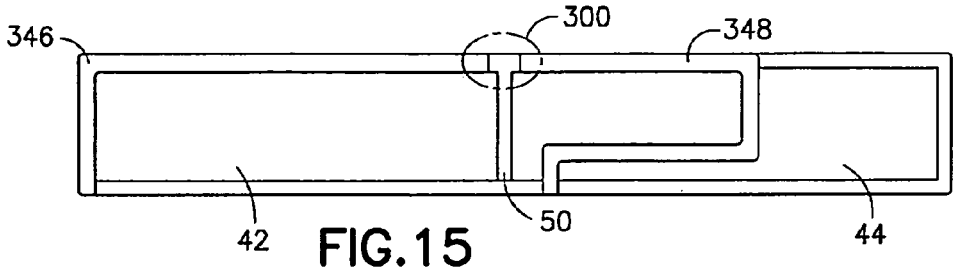
FIG. 15 illustrates an example where a RF gap is co-located with a mechanical gap.
Figure 16:
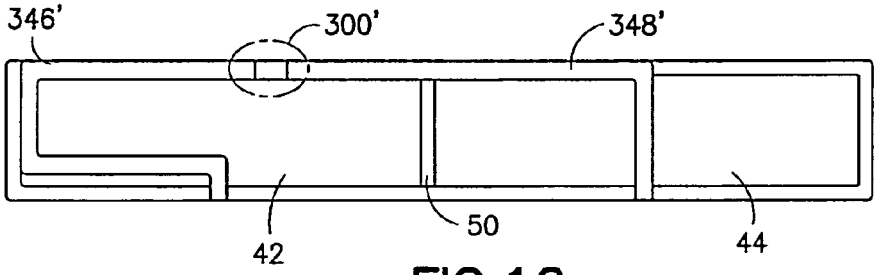
FIG. 16 illustrates an example where a RF gap is not co-located with a mechanical gap.

Referring also to FIGS. 15-18, the figures are presented to demonstrate how the mechanical dimensional tolerances of the mechanical gap may affect the radio frequency (RF) coupling gap between the fed antenna and the parasitic element. It should be appreciated that the mechanical gap 50 is created where the two carriers 42, 44 are brought together or joined. As shown in FIGS. 15 and 16, at least a part of the fed antenna 348 or 348' is on the second carrier 44 and at least a part of the parasitic element 346 of 346' is on a first carrier 42, which is different from the second carrier 44. FIG. 15 shows an example when the RF coupling gap 300 between the two antenna elements 346, 348 is co-located with the mechanical gap 50. In FIG. 15 the fed antenna 348 is completely disposed on the second carrier 44 and the parasitic element 346 is completely disposed on the first carrier 42. FIG. 16 shows an example when the RF coupling gap 300' is not co-located with the mechanical gap 50. In FIG. 16 the fed antenna 348' is partially disposed on the first carrier 42 and partially disposed on the second carrier 44, and the parasitic element 346' is completely disposed on the first carrier 42. In an alternate example embodiment the parasitic element may be partially disposed on the first carrier 42 and partially disposed on the second carrier 44, in combination with the fed antenna being be completely disposed on the second carrier 44. In this alternate example, the RF coupling gap may be on the second carrier 44 with all of the fed antenna and only part of the parasitic element.

Figure 17:
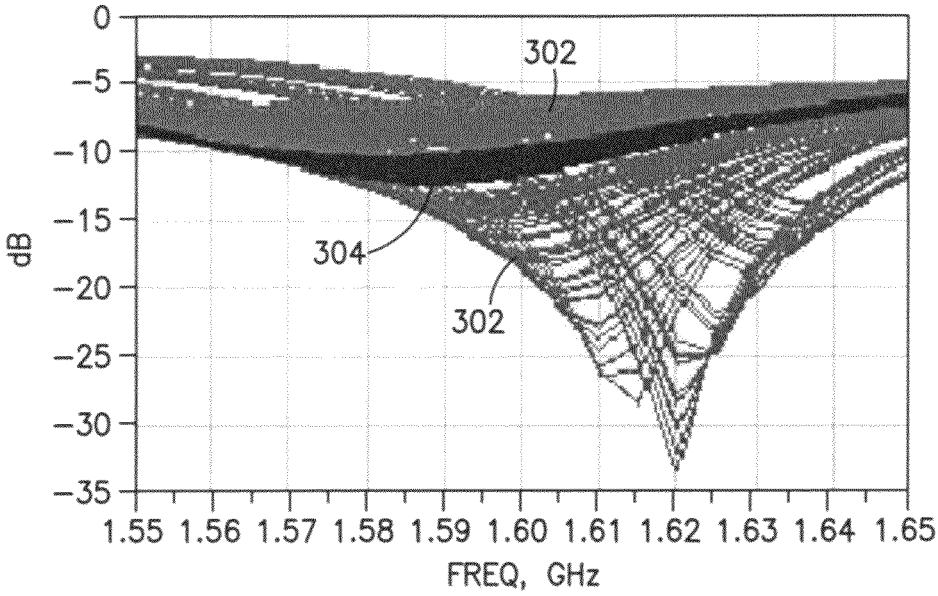
FIG. 17 illustrates a simulation of impedance regarding amplitude in dB to compare the examples shown in FIGS. 15-16.
Figure 18:
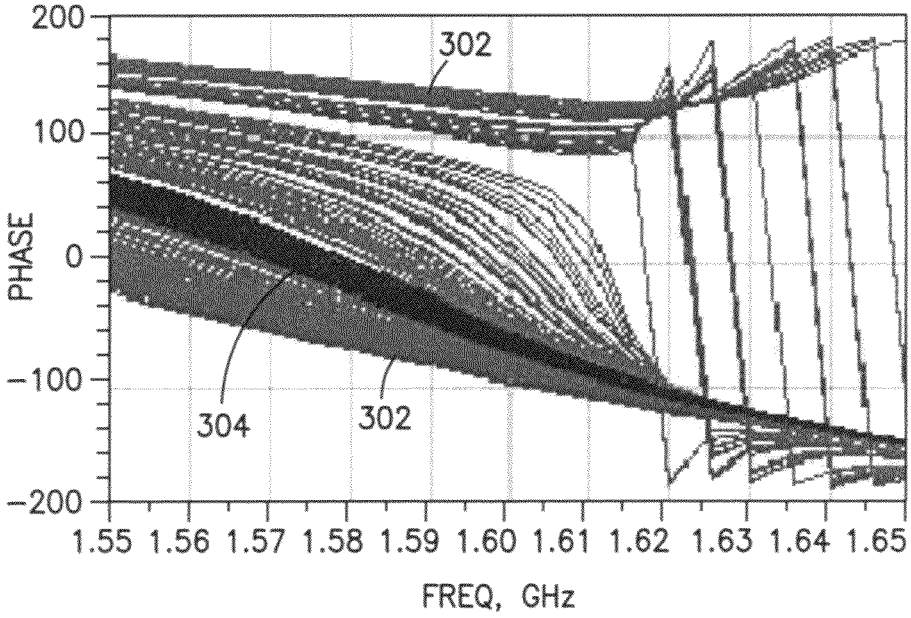
FIG. 18 illustrates a simulation of impedance regarding phase to compare the examples shown in FIGS. 15-16.

FIGS. 17 and 18 show simulations for the two examples shown in FIGS. 15 and 16, where 302 corresponds to FIG. 15 and 304 corresponds to FIG. 16. The 304 traces in the simulated results show that the impedance is much more stable in terms of amplitude and phase when compared to the 302 traces. Thus, the configuration shown in FIG. 16, where the RF gap 300' is not co-located with the mechanical gap 50, provides impedance which is much more stable in terms of amplitude and phase relative to the configuration shown in FIG. 15.

In the description above, the wording 'connect' and 'couple' and their derivatives may mean operationally connected or coupled. It should be appreciated that intervening component(s) may exist. Also, no intervening components may exist. Additionally, it should be understood that a connection or coupling may be a physical galvanic connection and/or an electromagnetic connection for example.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An apparatus comprising:

an antenna;

a first antenna carrier forming a first support substrate for a first portion of the antenna; and a different second antenna carrier forming a second support substrate for a second portion of the antenna, where the first and second antenna carriers are coupled to each other, and where the antenna extends across a joint between the first and second antenna carriers, where the antenna comprises an active element and a parasitic element, where the second portion of the antenna comprises the parasitic element, and where the first portion of the antenna com rises the active element.

2. An apparatus as in claim 1 where the first portion of the antenna comprises a portion of the parasitic element.

3. An apparatus as in claim 1 where the first antenna carrier is formed by a first manufacturing process with a first material, and where the second antenna carrier is formed with a second different manufacturing process with a second different material.

4. An apparatus as in claim 1 where the antenna comprises a radiating element, where the radiating element comprises a first portion having a first E-field magnitude and a second portion having a second E-field magnitude, where the second E-field magnitude is lower than the first E-field magnitude and the second portion is configured to extend across the joint.

5. An apparatus as in claim 1 where the first antenna carrier is a flex plastic carrier, and where the second antenna carrier is a Laser Direct Structuring (LDS) carrier.

6. An apparatus as in claim 1 where the first antenna carrier is a Laser Direct Structuring (LDS) carrier, and where the second antenna carrier is a flex plastic carrier.

7. An apparatus as in claim 1 where a first antenna element of the antenna is coupled to a second antenna element of the antenna on the first antenna carrier at a location spaced from the joint.

8. An apparatus as in claim 7 where the first antenna element of the antenna is coupled to the second antenna element of the antenna by a magnetic coupling.

9. An apparatus as in claim 7 where the first antenna element of the antenna is coupled to the second antenna element of the antenna by an electrical coupling.

10. An apparatus as in claim 7 where the antenna comprises a first antenna element and a second element, where the second antenna element forms the second portion and part of the first portion, where the second antenna element extends across the joint, and where the first antenna element does not extend across the joint.

11. An apparatus as in claim 1 where the first portion of the antenna is coupled to the second portion of the antenna on the first antenna carrier at the joint.

12. An apparatus as in claim 11 where the first portion of the antenna is coupled to the second portion of the antenna by a magnetic coupling.

13. An apparatus as in claim 11 where the first portion of the antenna is coupled to the second portion of the antenna by an electrical coupling.

14. An apparatus as in claim 1 where the first and second antenna carriers are in a partially stacked configuration, and where the joint is at a plane in the stacked configuration.

15. A method comprising:

forming a first antenna carrier comprising a first manufacturing method;

providing a first antenna element of an antenna on the first antenna carrier, where the first antenna carrier forms a first substrate for the first antenna element;

forming a second antenna carrier comprising a second different manufacturing method;

providing a second antenna element of the antenna on the second antenna carrier, where the second antenna carrier forms a second different substrate for the second antenna element; and coupling the first and second antenna elements to each other, where the second antenna element of the antenna comprises a parasitic element, and where the first antenna element of the antenna comprises an active element.

16. A method as in claim 15 where the first and second methods each comprise a different one of the following:

forming a flex carrier, forming a Laser Direct Structuring (LDS) carrier, forming an overmolded member on the first antenna element or second antenna element, or forming an overmolded member on the first antenna element and the first antenna carrier or forming an overmolded member on the second antenna element and the second antenna carrier.

17. A method as in claim 15 where coupling the first and second antenna elements comprises the first antenna element being coupled to the second antenna element on the first antenna carrier at a location spaced from a joint between the first and second antenna carriers.

18. A method as in claim 17 where the first antenna element is coupled to the second antenna element by a magnetic coupling.

19. A method as in claim 17 where the first antenna element is coupled to the second antenna element by an electrical connection.

20. A method as in claim 15 where the method comprises the second antenna element extending across a joint between the first and second antenna carriers, where the second antenna element is provided on the first antenna carrier, and where the first antenna element does not extend across the joint.

21. A method as in claim 15 where the method comprises coupling the first antenna element to the second antenna element at the joint between the first and second antenna carriers.

22. A method as in claim 15 where the method comprises coupling the first antenna element to the second antenna element by a magnetic coupling.

23. A method as in claim 15 where the method comprises coupling the first antenna element to the second antenna element by a direct electrical connection with each other.

24. A method as in claim 15 where the method comprises stacking the first antenna carrier with the second antenna carrier in a partially stacked configuration, and where a joint between the first and second antenna carriers is at a plane in the stacked configuration.

25. An apparatus comprising:

an antenna comprising an active element and a parasitic element; and an antenna support having the antenna thereon, where the antenna support comprises a first antenna carrier coupled to a second different antenna carrier, where the active element is on the first antenna carrier, where the first antenna carrier is formed with a first manufacturing process with a first material, and where the parasitic element is on the second antenna carrier, where the second antenna carrier is formed with a second different manufacturing process with a second different material.

* * * * *

UNITED STATES PATENT AND TRADEMARK OFFICE

CERTIFICATE OF CORRECTION

PATENT NO. : 8,896,489 B2
APPLICATION NO. : 13/475345
DATED : November 25, 2014
INVENTOR(S) : Larsen et al.

It is certified that error appears in the above-identified patent and that said Letters Patent is hereby corrected as shown below:

In the Claim

Col. 11, line 4, claim 1, delete “com rises” and insert --comprises--.

Signed and Sealed this
Third Day of March, 2015

Michelle K. Lee

Michelle K. Lee
*Deputy Director of the United States Patent and Trademark Office*